US009592410B2

(12) United States Patent
Kanno et al.

(10) Patent No.: US 9,592,410 B2
(45) Date of Patent: Mar. 14, 2017

(54) VOICE TRANSMITTER

(71) Applicant: KOKEN LTD., Tokyo (JP)

(72) Inventors: Ryo Kanno, Tokyo (JP); Shoko Matsuda, Tokyo (JP)

(73) Assignee: KOKEN LTD., Tokyo (JP)

( * ) Notice: Subject to any disclaimer, the term of this patent is extended or adjusted under 35 U.S.C. 154(b) by 0 days.

(21) Appl. No.: 14/767,473

(22) PCT Filed: Feb. 12, 2014

(86) PCT No.: PCT/JP2014/053139

§ 371 (c)(1),
(2) Date: Aug. 12, 2015

(87) PCT Pub. No.: WO2014/126083

PCT Pub. Date: Aug. 21, 2014

(65) Prior Publication Data

US 2016/0001109 A1 Jan. 7, 2016

(30) Foreign Application Priority Data

Feb. 15, 2013 (JP) ..... 2013-027642
Feb. 5, 2014 (JP) ..... 2014-019979

(51) Int. Cl.
*A62B 18/08* (2006.01)
*G10K 11/18* (2006.01)
(Continued)

(52) U.S. Cl.
CPC ..... *A62B 18/08* (2013.01); *G10K 11/18* (2013.01); *G10K 13/00* (2013.01)

(58) Field of Classification Search
CPC ..... A62B 18/08; A62B 18/00; G10K 11/18; G10K 13/00
(Continued)

(56) References Cited

U.S. PATENT DOCUMENTS 1,730,227 A * 10/1929 McBride ..... A62B 18/08 128/201.15
3,109,425 A * 11/1963 Gongoll ..... A62B 18/10 128/201.19
(Continued)

FOREIGN PATENT DOCUMENTS

CA 2134914 5/1995
JP 7-185027 7/1995
(Continued)

OTHER PUBLICATIONS

International Search Report mailed Mar. 25, 2014 for corresponding International Patent Application No. PCT/JP2014/053139.

*Primary Examiner* — Edgardo San Martin
(74) *Attorney, Agent, or Firm* — Staas & Halsey LLP

(57) ABSTRACT

Provided is a voice transmitter in a simple structure that can be manufactured at a low cost, and can make speech uttered by a wearer clearly hearable at the outside. In a voice transmitter unit that transmits the speech uttered by the wearer to the outside, a voice transmitter body of the voice transmitter unit includes: a diaphragm member able to transmit the speech from one side to the other side; and a holding member to hold at least a part of the diaphragm member, wherein the diaphragm member is formed of a heat-shrinkable material, and the diaphragm member is heated to be shrunk while the diaphragm member is held by the holding member, thereby holding the diaphragm member by the holding member while substantially an entire surface of the diaphragm member is tensed.

6 Claims, 13 Drawing Sheets

(51) Int. Cl.
*G10K 13/00* (2006.01)
*A62B 18/00* (2006.01)

(58) Field of Classification Search
USPC ..... 181/167, 21; 128/201.19, 205.25
See application file for complete search history.

(56) References Cited

U.S. PATENT DOCUMENTS

| | | | | | |
|---|---|---|---|---|---|
| 3,124,130 | A * | 3/1964 | Klinger | A62B 18/08 | 128/201.19 |
| 3,140,754 | A * | 7/1964 | Motsinger | A62B 18/08 | 128/201.19 |
| 3,834,231 | A * | 9/1974 | Hisada | G01F 3/225 | 73/279 |
| 5,038,459 | A * | 8/1991 | Yasuda | H04R 19/00 | 228/114.5 |
| 5,895,537 | A * | 4/1999 | Campbell | A62B 18/08 | 156/290 |
| 6,305,370 | B1 * | 10/2001 | Rosert | A62B 18/08 | 128/201.19 |
| 7,610,670 | B2 * | 11/2009 | Akino | H04R 31/003 | 181/158 |

FOREIGN PATENT DOCUMENTS

| | | |
|---|---|---|
| JP | 2000-189529 | 7/2000 |
| JP | 2001-275187 | 10/2001 |
| JP | 2002-27582 | 1/2002 |
| JP | 2002-219185 | 8/2002 |

* cited by examiner

FIG. 11

| PRODUCING CONDITION | 140°C30SECONDS | | 160°C60SECONDS | |
|---|---|---|---|---|
| FREQUENCY [Hz] | LOWER FREQUENCY 700Hz | HIGHER FREQUENCY 3200Hz | LOWER FREQUENCY 700Hz | HIGHER FREQUENCY 3200Hz |
| MEMBRANE PRESSURE | 18.5 | | 28.3 | |
| NOISE TRANSMITTANCE [dBA] | 59.9 | | 57.7 | |
| NOISE VALUE PER FREQUENCY [dBA] | 37.5 | 5.6 | 14.8 | 18.8 |

VOICE TRANSMITTER

CROSS REFERENCE TO RELATED APPLICATIONS

This application is based on and hereby claims priority to International Application No. PCT/JP2014/053139 filed on Feb. 12, 2014 and Japanese Applications No. 2013-027642 filed on Feb. 15, 2013 and No. 2014-019979 filed on Feb. 5, 2014, the contents of which are hereby incorporated by reference.

TECHNICAL FIELD

The present invention relates to a voice transmitter for use in a protective mask or a protective garment used for the purpose of securing respiration of a wearer from various substances and conditions noxious to a human body.

BACKGROUND ART

In order to secure respiration of operators who operate in various substances and conditions noxious to human bodies, there are various conventional protective masks and protective garments. Because these protective masks and protective garments bring persons who wear the protective masks or the protective garments (referred to simply as a "wearer or wearers", hereinafter) into a state in which mouths and faces of the wearers are covered, and thus speech uttered by the wearers becomes difficult to be transmitted to the outside; therefore, the speech uttered by the wearers becomes difficult to be clearly heard by other persons. To cope with such a situation, there has been known a configuration to provide protective masks and protective garments with voice transmitters for clearly transmitting speech uttered by wearers to the outside (see Japanese Patent Laid-Open No. 2002-219185, for example). A voice transmitter of Japanese Patent Laid-Open No. 2002-219185 uses a speaking diaphragm to transmit speech of a wearer to the outside while his or her mouth and the like are covered.

SUMMARY OF INVENTION

Technical Problem

In the voice transmitter, it is preferable to put a voice diaphragm in a state of being tensed at a predetermined tension in order to secure a sufficient voice transmission performance. For this reason, in the voice transmitter of Patent Literature 1, a cover is provided with an inner annular rib and a housing is provided with a projection so as to hold a voice diaphragm therebetween, thereby applying a predetermined tension to this speaking diaphragm. Unfortunately, in the invention described in Patent Literature 1, in order to attain the above state in which the predetermined tension is applied, an extremely highly accurate procedure is required.

The present invention has been made in order to solve the above problems, and an object thereof is to provide a voice transmitter in a simple structure that can be manufactured at a low cost, and can make speech uttered by a wearer clearly hearable at the outside.

Solution to Problem

In order to achieve the above object, the present invention provides a voice transmitter that transmits speech uttered by a wearer to an outside, the voice transmitter including: a diaphragm member able to transmit the speech from one side to the other side; and a holding member to hold at least a part of the diaphragm member, wherein the diaphragm member is formed of a heat-shrinkable material, and the diaphragm member is heated to be shrunk while the diaphragm member is held by the holding member, thereby holding the diaphragm member by the holding member while substantially an entire surface of the diaphragm member is tensed.

In one of preferable embodiments of the present invention, the holding member is formed to be a frame having a predetermined shape, and an aperture formed on an inner side of the holding member is covered with the diaphragm member.

In the present invention, it is preferable that at least one of a heating temperature and a heating time of the diaphragm member is so controlled as to adjust a degree of tension applied to the diaphragm member to be a predetermined value.

Advantageous Effects of Invention

In the voice transmitter according to the present invention, it is configured that the diaphragm member is formed of a heat-shrinkable material, and the diaphragm member is heated to be shrunk while the diaphragm member is held by the holding member, thereby holding the diaphragm member by the holding member while the substantially entire surface of the diaphragm member is tensed. Hence, the diaphragm member becomes shrunk only by heating the diaphragm member while the diaphragm member is held by the holding member. Without forming the holding member into a complicated shape or configuration, or without fitting components of the holding member to each other with a strong force, the diaphragm member can be held by the holding member while the substantially entire area of the diaphragm member is tensed by the holding member, thus securely preventing generation of wrinkles and sagging of the diaphragm member. Accordingly, it is possible to provide the voice transmitter in a simple structure that can be manufactured at a low cost, and can make speech uttered by a wearer clearly hearable at the outside.

It is configured that the holding member is formed to be a frame having a predetermined shape, and the aperture formed on the inner side of the holding member is covered with the diaphragm member. With this configuration, the diaphragm member is heated to be shrunk, thereby applying tension to the diaphragm member in all directions around the circumference of the diaphragm member. Hence, it is possible to more securely suppress generation of wrinkles and sagging of the diaphragm member, thus making the speech uttered by the wearer more clearly hearable at the outside.

A degree of tension applied to the diaphragm member can be adjusted by controlling at least one of the heating temperature and the heating time of the diaphragm member to a predetermined value, thereby easily adjusting the frequency characteristics of the speech transmitted through this diaphragm member.

BRIEF DESCRIPTION OF DRAWINGS

Reference will now be made in detail to the preferred embodiments of the present invention, examples of which are illustrated in the accompanying drawings, wherein like reference numerals refer to like elements throughout.

FIG. 11 is a table showing a relation between a heating condition and frequency characteristics of the voice transmitter unit according to Embodiment 1.

DESCRIPTION OF EMBODIMENTS

Embodiment 1 of the present invention is shown in FIG. 1 to FIG. 6.

Figure 3:
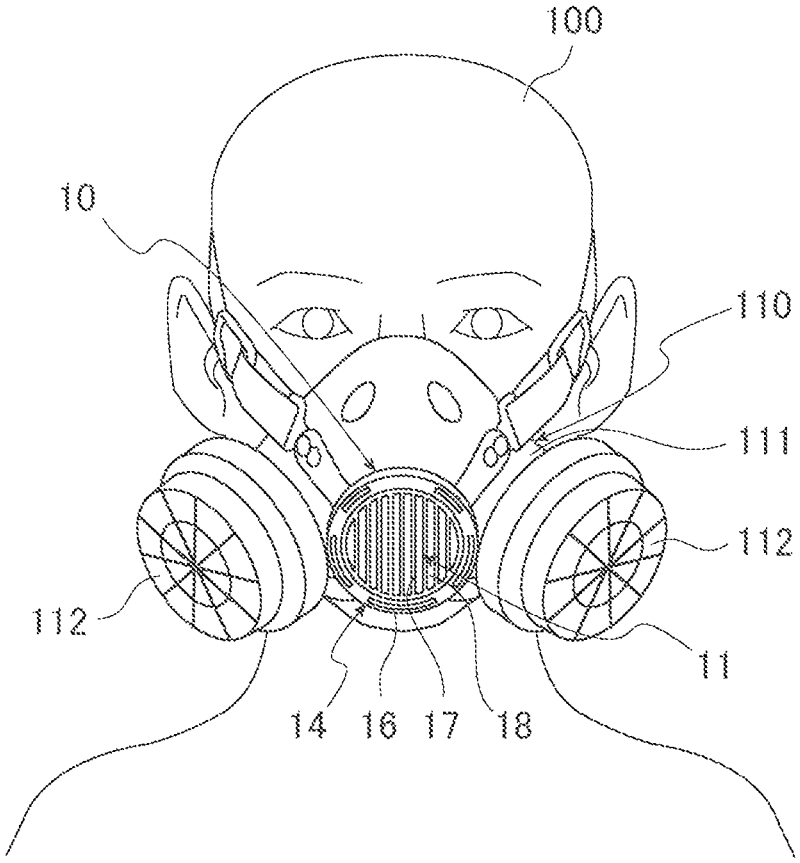
FIG. 3 is an exterior drawing schematically showing a state in which the voice transmitter unit of Embodiment 1 of the present invention is used in a protective mask.
Figure 4:
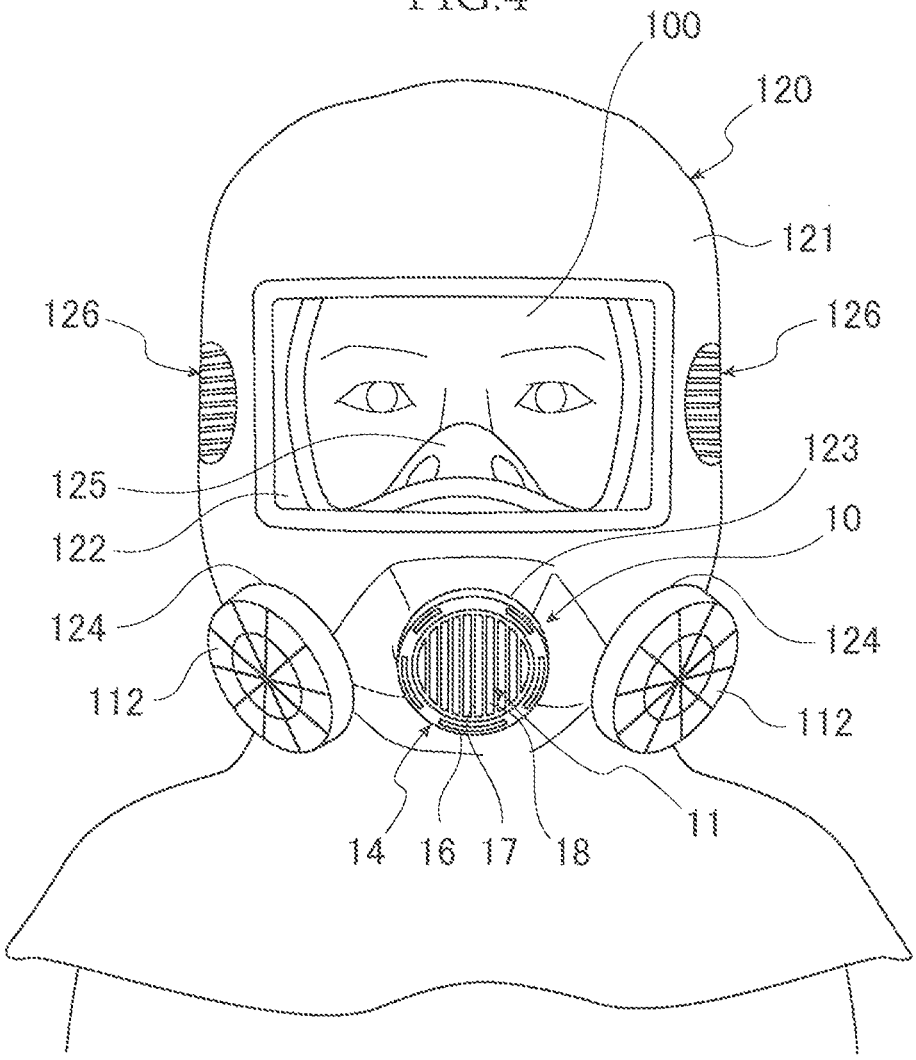
FIG. 4 is an exterior drawing schematically showing a state in which the voice transmitter unit of Embodiment 1 of the present invention is used in a protective garment.

First, in explanation of a configuration of the present invention, a voice transmitter unit 10 of this Embodiment 1 is provided to a protective mask 110 as shown in FIG. 3 or a protective garment 120 as shown in FIG. 4 so as to transmit speech uttered by a wearer 100 who wears the protective mask 110 or the protective garment 120 to the outside.

Figure 1:
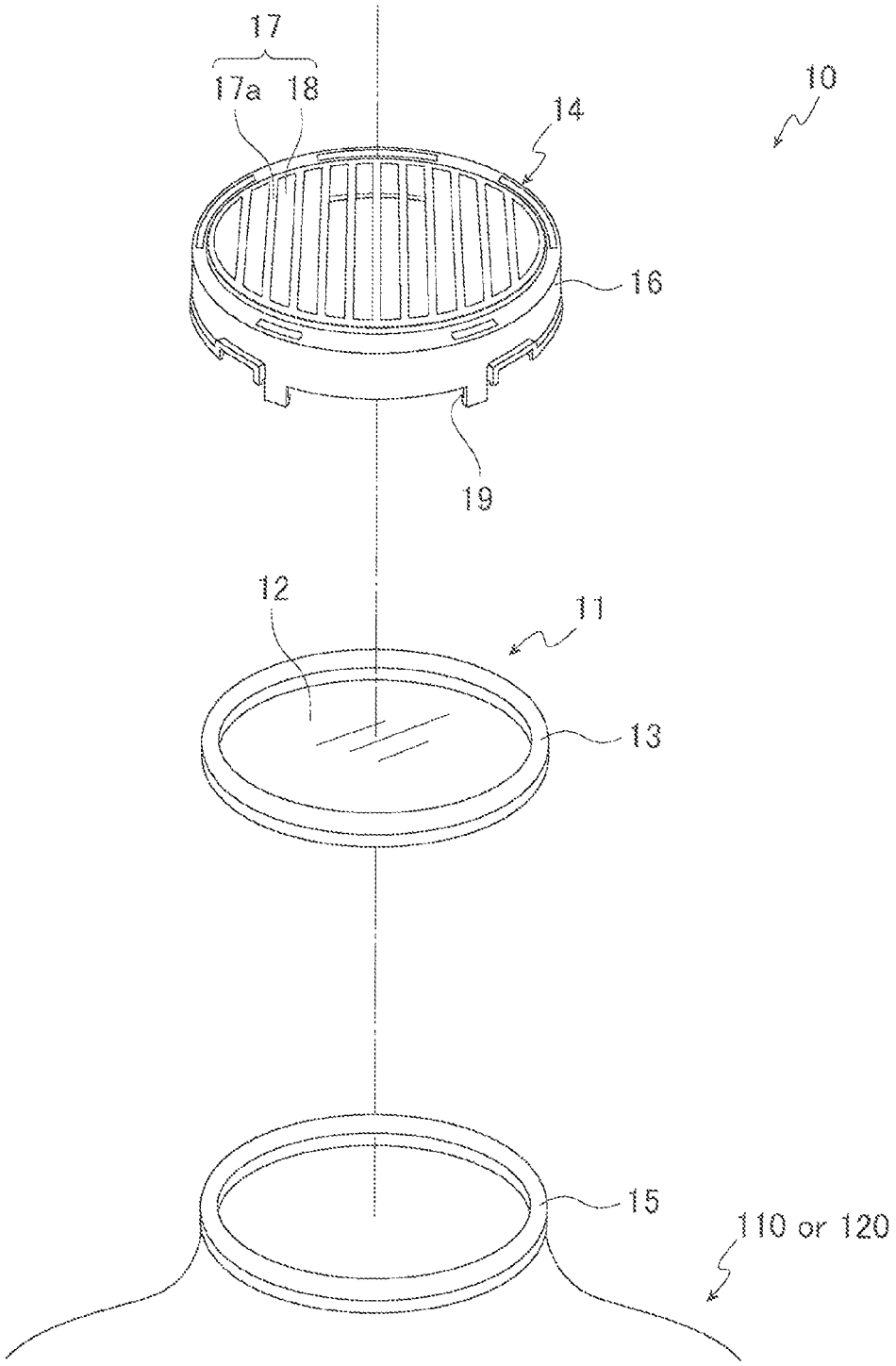
FIG. 1 is an exploded perspective view schematically showing components included in a voice transmitter unit according to Embodiment 1 of the present invention.

As shown in FIG. 1, the voice transmitter unit 10 of this Embodiment 1 includes a voice transmitter body 11, a cover member 14, and a mounting base 15.

The voice transmitter body 11 of this Embodiment 1 includes a diaphragm member 12 and a holding member 13.

The diaphragm member 12 is formed of a heat-shrinkable material, such as a material of polypropylene and polyester. The diaphragm member 12 is made of the above material as a thick-film member, and is capable of transmitting speech from one side to the other side. The diaphragm member 12 is preferably formed to have a film thickness of approximately 0.01 to 0.2 mm. In this Embodiment 1, the diaphragm member 12 is formed to have a film thickness of approximately 0.05 mm. The diaphragm member 12 may be formed by using any material with any thickness as far as the material has a heat-shrinkable property, and can transmit speech uttered by the wearer 100 from one side (i.e., the inside of the voice transmitter unit 10) to the other side (i.e., the outside of the voice transmitter unit 10).

An entire shape of the diaphragm member 12 is formed to be larger than an outer diameter of the holding member 13. The shape of the diaphragm member 12 may be the same as an outer edge shape of the holding member 13, but the present invention is not limited to the same shape as that of the holding member 13.

The holding member 13 is formed of resin having a high rigidity or the like. The holding member 13 is formed in a frame shape. Specifically, the holding member 13 is formed in a ring shape in this Embodiment 1.

The voice transmitter body 11 is held between the cover member 14 and the mounting base 15.

The cover member 14 is formed by a member made of resin having a high rigidity or the like. A member body 16 of the cover member 14 is formed in a substantially cylindrical shape. The member body 16 has an inner diameter slightly larger than a diameter of the voice transmitter body 11 so that the voice transmitter body 11 can be housed in the member body 16.

A protective member 17 is disposed on one end side of the cover member 14. The protective member 17 is formed by arranging plural stick-like members 17*a* side by side. A gap 18 is formed between every two adjacent stick-like members 17*a*. The above configuration of the protective member 17 attains both preferable voice transmission and damage prevention of the voice transmitter body 11 from external ballistic fragments. Any configuration (e.g., tiltingly arranging plural plate bodies side by side, making a grid form, or having a number of small holes) of the protective member 17 may be employed as far as the preferable speech transmission and the damage prevention of the voice transmitter body 11 can be both attained.

Locking portions 19 are projectingly formed at a lower end of the member body 16. An inwardly curved hook is provided at a front end of each locking portion 19, and these hooks are locked to the mounting base 15 described later.

The mounting base 15 is disposed on a front surface of the protective mask 110 or the protective garment 120 in use at a portion located closely to a front of the mouth of the wearer 100. The mounting base 15 is formed of a high-rigidity resin or the like in a substantially ring shape. An outer diameter of the mounting base 15 is formed to be substantially the same as an outer diameter of the voice transmitter body 11.

The mounting base 15 may be joined to the protective mask 110 or the protective garment 120, may be integrally formed with the protective mask 110 or the protective garment 120, or may be formed to be detachable relative to the protective mask 110 or the protective garment 120. The entire voice transmitter unit 10 may be joined to the protective mask 110 or the protective garment 120, or may be integrally formed with the protective mask 110 or the protective garment 120. Specifically, a part or whole of the voice transmitter unit 10 may be detachable to, or integrally formed with the protective mask 110 or the protective garment 120.

The protective mask 110 as shown in FIG. 3 is a gas mask, a dust respirator, an airline respirator, a respirator, or the like, and is used for protecting respiration of an operator from dusts, fine toxic substances such as asbestos, air polluted by a poisonous gas, harmful aerosol, microbes, or toxins. As shown in FIG. 3, the voice transmitter unit 10 of this Embodiment is disposed to a portion of a mask main body 111 of the protective mask 110 corresponding to the front of the mouth of the wearer 100 when the wearer 100 wears the mask. The mask main body 111 is provided with a filter member 112 that filters dusts and toxic substances.

Basically, any configuration may be employed for the protective mask 110. For example, a facepiece or the like of the protective mask 110 may be of a semi-half face type shown in FIG. 3, a full face type, or a face shield type. An air intake mechanism of the protective mask 110 may be of a so-called air-feed type including a self-respirator, for example, other than a filtering type as shown in FIG. 3.

The protective garment 120 as shown in FIG. 4 may be a chemical protective garment, a ballistic-fragment protective garment, a fall protective garment, an electric-work protective garment, a radiation protective garment, a fire protective garment, a wasp-extermination protective garment, or an explosion protective garment, for example. FIG. 4 shows the protective garment 120 of a hood type covering the head to the shoulder of the wearer 100. It should be noted that protective garments of other types may also be employed, as described later.

A protective garment body 121 of the protective garment 120 is formed by using fabric made of a material impermeable to dusts or toxic substances. There is provided a transparent window 122 at a position of the protective garment body 121 corresponding to the eyes of the wearer 100 when the wearer 100 wears the protective garment. A central aperture 123 is formed in the protective garment 120, and the mounting base 15 as well as the voice transmitter unit 10 are disposed to this central aperture 123. Side apertures 124 are formed at both side portions relative to the central aperture 123, and the filter member 112 is disposed to each of the side apertures 124. The voice transmitter unit 10 and the filter member 112 are coupled to a mask 125 worn by the wearer 100 inside the protective garment body 121. This configuration attains both respiration of the wearer 100 who wears the protective garment 120 and transmission of speech uttered by the wearer 100 to the outside.

As shown in FIG. 4, there is disposed a listening unit 126 for allowing the wearer 100 in the protective garment 120 to readily listen to external sounds at a portion of the protective garment body 121 corresponding to each ear of the wearer 100 when the wearer 100 wears the garment. The listening unit 126 may be configured in the same manner as that of the voice transmitter unit 10, thereby attaining reduction in cost of the protective garment 120.

Basically, the protective garment 120 may be configured in any manner. For example, as shown in FIG. 4, instead of the configuration of covering the head to the shoulder of the wearer 100, the protective garment 120 may be of a suit type that covers the entire body of the wearer 100. A portion of the protective garment 120 corresponding to the face of the wearer 100 may be opened so as to expose the face (in a state of wearing the mask 125) of the wearer 100 to the outside. It may be configured that an air supply unit (not shown) that sends clean air to the inside of the protective garment 120 is provided so that it is unnecessary for the wearer 100 to wear the mask 125 inside the protective garment 120.

Next, a fabricating process of the voice transmitter body 11 of this Embodiment will be described.

Figure 2A:
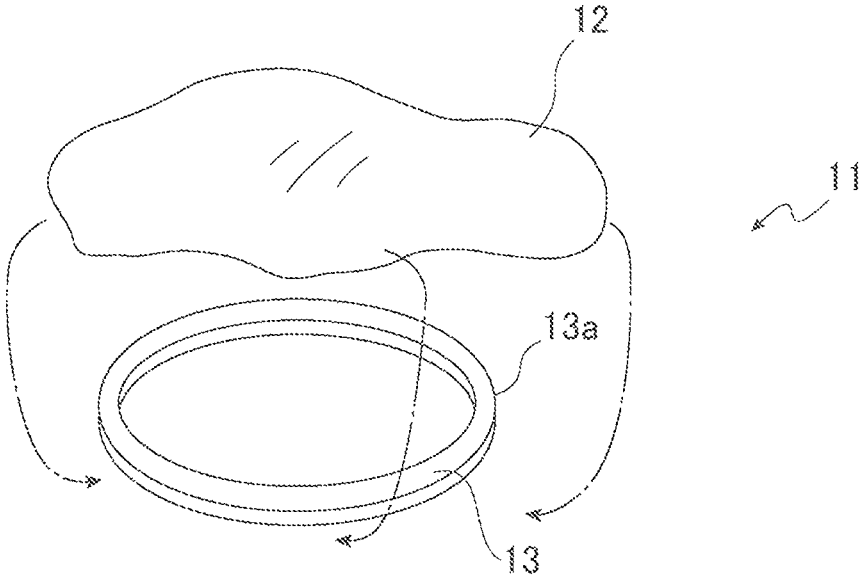
FIG. 2A is an exploded perspective view schematically showing components of a voice transmitter body in the voice transmitter unit according to Embodiment 1 of the present invention.
Figure 2B:
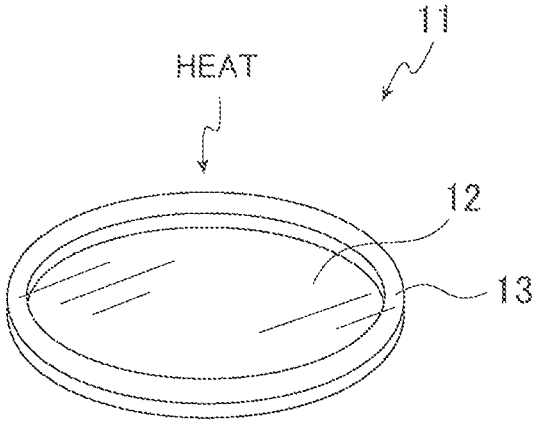
FIG. 2B is a perspective view schematically showing a state in which the voice transmitter body is assembled in the voice transmitter unit according to Embodiment 1 of the present invention.

As shown in FIG. 2A, the diaphragm member 12 is disposed on one surface of the holding member 13. At this time, the one surface of the holding member 13 is entirely covered with the diaphragm member 12. In this state, a peripheral edge portion of the diaphragm member 12 is wrapped around a peripheral edge portion 13*a* of the holding member 13 to the other surface thereof. Specifically, the peripheral edge portion of the diaphragm member 12 is brought into a state of being wrapped around under a lower surface of the holding member 13 as shown in FIG. 2A.

In this state, if the diaphragm member 12 is heated, the diaphragm member 12 becomes shrunk due to heat. At this time, the peripheral edge portion of the diaphragm member 12 (specifically, the portion wrapped around under the lower surface of the holding member 13) also becomes shrunk, thus generating a tensile force to pull the holding member 13 toward the inside. As a result, the diaphragm member 12 covers the holding member 13 while the tension is maintained, thereby holding the diaphragm member 12 by the holding member 13. This tension maintains a portion of the diaphragm member 12 located on an upper surface of the holding member 13 to be in a state of having no wrinkles and no sagging. Through the above processing, the voice transmitter body 11 is completed.

Next, a usage procedure of the voice transmitter unit 10 of this Embodiment will be described as below.

For example, if the voice transmitter unit 10 is used in the protective mask 110, from a state as shown in FIG. 1, the wearer 100 houses the voice transmitter body 11 in the cover member 14. The wearer 100 mounts the cover member 14 on the mounting base 15 of the protective mask 110, and locks the hooks of the locking portions 19 to the mounting base 15 so as to hold the voice transmitter body 11 between the cover member 14 and the mounting base 15. In this manner, the voice transmitter unit 10 is mounted to the protective mask 110.

The wearer 100 places the protective mask 110 on which the voice transmitter unit 10 is mounted at a position of his or her mouth, and puts strings on the ears, thereby completing the wearing of the protective mask 110. In this state, the wearer 100 can use the protective mask 110.

Similarly, in the case of using the voice transmitter unit 10 in the protective garment 120, the cover member 14 in which the voice transmitter body 11 is housed is mounted on the mounting base 15 of the protective garment 120, and the voice transmitter unit 10 is mounted on the protective garment 120, and thereafter, the wearer 100 wears the protective garment 120.

Next, a relation between a heating condition and frequency characteristics of the voice transmitter unit 10 of this Embodiment 1 will be described using FIG. 11.

The present inventors produced the holding members 13 of plural different types using various heating temperatures and various heating times. The present inventors measured transmission amounts of speech in a lower frequency region (700 Hz in this case) and a higher frequency region (3200 Hz in this case) for each of these holding members 13.

In this case, polypropylene having a thickness of 15 μm was used as the diaphragm member 12. In each diaphragm member 12, a region contributing to transmission of speech was defined to be a circular region having a diameter of 36 mm. This measurement was carried out using Sound Level Meter Class 1 NL-52 manufactured by RION Co., Ltd. as a measuring instrument in such a manner that speech at 70 [dB] was measured at a position as far as 1 m away from the speech for two minutes.

FIG. 11 is a table showing part of measurement results. As shown in FIG. 11, in the case of the heating temperature of 140° C. and the heating time of 30 seconds, a tension applied to the diaphragm member 12 (i.e., membrane pressure in FIG. 11) was 18.5 [g/cm$^2$], and a transmittance of the speech in entire frequency band was 59.9 [dBA]. A transmittance of speech at 700 [Hz] was 37.5 [dBA], and a transmittance of speech at 3200 [Hz] was 5.6 [dBA].

Meanwhile, in the case of the heating temperature of 160° C. and the heating time of 60 seconds, a tension applied to the diaphragm member 12 was 28.3 [g/cm$^2$], and a transmittance of speech in the entire frequency band was 57.7 [dBA]. A transmittance of speech at 700 [Hz] was 14.8 [dBA], and a transmittance of speech at 3200 [Hz] was 18.8 [dBA].

As shown in FIG. 11, a value of the tension of the diaphragm member 12 could be adjusted by changing the heating temperature and the heating time. It was found that if the tension is smaller, the transmittance of speech in the lower frequency range became greater, and if the tension is greater, the transmittance of speech in the higher frequency range became greater.

Based on this result, it was confirmed that a wearer having a lower voice can easily transmit his or her speech to the outside if using the voice transmitter unit 10 including the diaphragm member 12 whose tension is smaller, and a wearer having a higher voice can easily transmit his or her speech to the outside if using the voice transmitter unit 10 including the diaphragm member 12 whose tension is greater.

In this manner, in this Embodiment 1, it is possible to adjust a value of the tension of the diaphragm member 12 by controlling the heating temperature and the heating time; therefore, it becomes easier to produce the voice transmitter unit 10 capable of readily transmitting speech to the outside by adjusting the value of the tension of the diaphragm member 12 in accordance with the voice characteristics (in accordance with the gender, the age, or the like, for example).

It is also possible to adjust a value of the tension of the diaphragm member 12 by controlling only one of the heating temperature and the heating time; thus, it is possible to adjust the frequency characteristics of the diaphragm member 12.

As aforementioned, in this Embodiment 1, it is configured that the diaphragm member 12 of the voice transmitter body 11 is formed of a heat-shrinkable material, and the diaphragm member 12 is heated to be shrunk while the diaphragm member 12 is held by the holding member 13, thereby holding the diaphragm member 12 by the holding member while the substantially entire surface of the diaphragm member 12 is tensed; therefore, the diaphragm member 12 becomes shrunk only by heating the diaphragm member 12 while the diaphragm member 12 is held by the holding member 13. Without forming the holding member 13 into a complicated shape or configuration, or without fitting components of the holding member 13 to each other with a strong force, the diaphragm member 12 can be held by the holding member 13 while the substantially entire area of the diaphragm member 12 is tensed by the holding member 13, thus securely preventing generation of wrinkles and sagging of the diaphragm member 12. Accordingly, it is possible to provide the voice transmitter body 11 and the voice transmitter unit 10 in a simple structure that can be manufactured at a low cost, and can make speech uttered by a wearer clearly hearable at the outside.

In this Embodiment 1, it is configured that the holding member 13 is formed to be a frame having a substantially circular shape in a front view or any shape, the aperture formed on the inner side of the holding member 13 is covered with the diaphragm member, and the diaphragm member 12 is heated to be shrunk, thereby applying tension to the diaphragm member 12 in all directions around the circumference of the diaphragm member 12. Hence, it is possible to more securely suppress generation of wrinkles and sagging of the diaphragm member 12.

In addition, according to this Embodiment 1, a degree of tension applied to the diaphragm member 12 can readily be adjusted by controlling at least one of the heating temperature and the heating time of the diaphragm member 12, hence it is possible to easily adjust the frequency characteristics of the speech transmitted through this diaphragm member 12. As a result, it is possible to readily produce the voice transmitter unit 10 at a low cost, which is capable of easily transmitting speech to the outside by adjusting the tension of the diaphragm member 12 in accordance with the voice characteristics with a high accuracy.

In FIG. 1 to FIG. 4 of this Embodiment 1, in the voice transmitter body 11 of the voice transmitter unit 10, the holding member 13 is illustrated in a substantially ring shape in a front view, but the holding member 13 is not limited to this, and any shape may be employed as far as the holding member 13 is formed in a frame shape.

Figure 5:
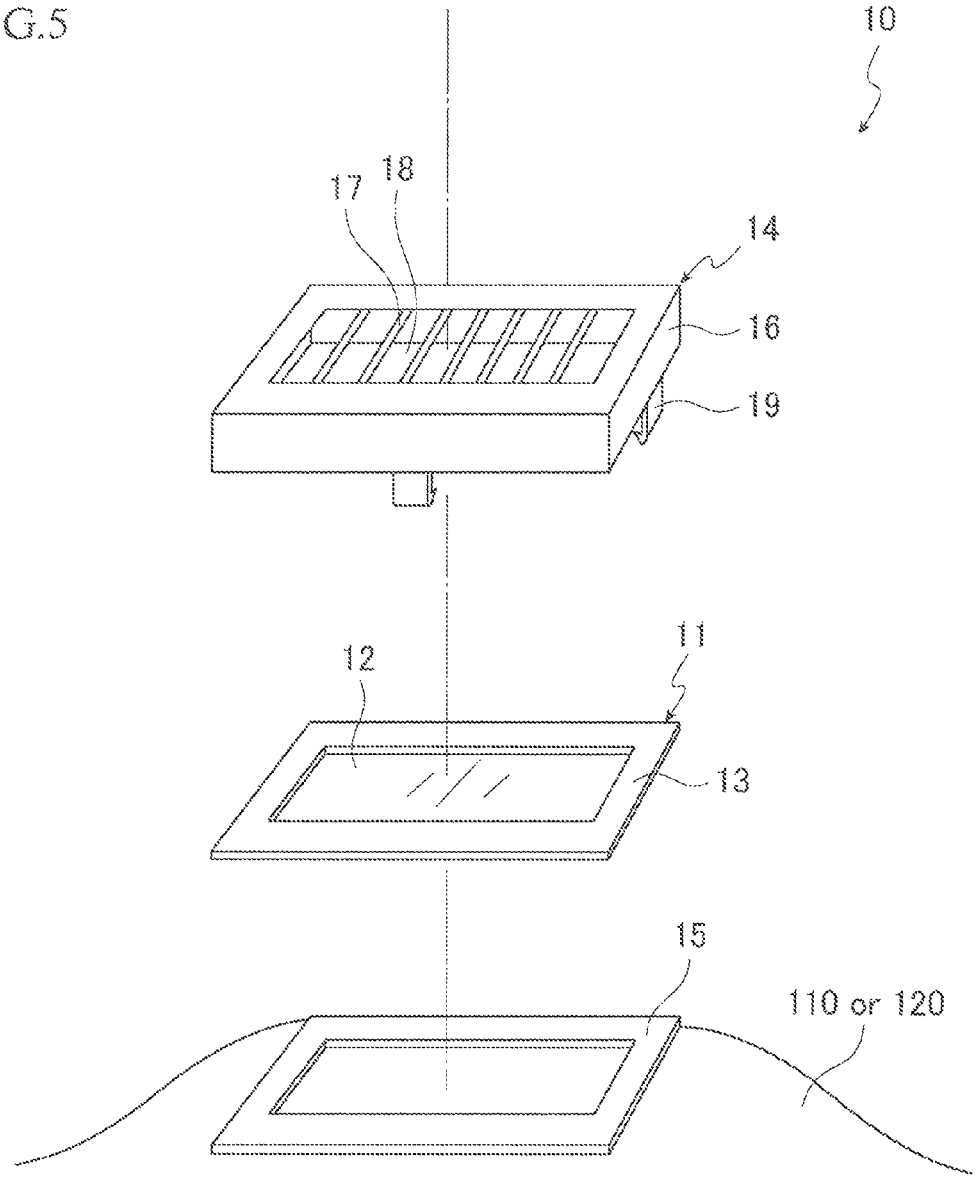
FIG. 5 is an exploded perspective view schematically showing components included in a first variation of the voice transmitter unit of Embodiment 1 of the present invention.

For example, as shown in a first variation in FIG. 5, the voice transmitter body 11, the cover member 14, and the mounting base 15 of the voice transmitter unit 10 are respectively formed in an approximately rectangular shape in a front view, and the holding member 13 of the voice transmitter body 11 is also formed in an annular form having a substantially rectangular shape in a front view. In this case, the diaphragm member 12 is also formed to be greater than the entire shape of the holding member 13. At this time, the member body 16 of the cover member 14 is formed in a substantially square pole shape, and the mounting base 15 is formed in a substantially rectangular shape in plain view.

Figure 6:
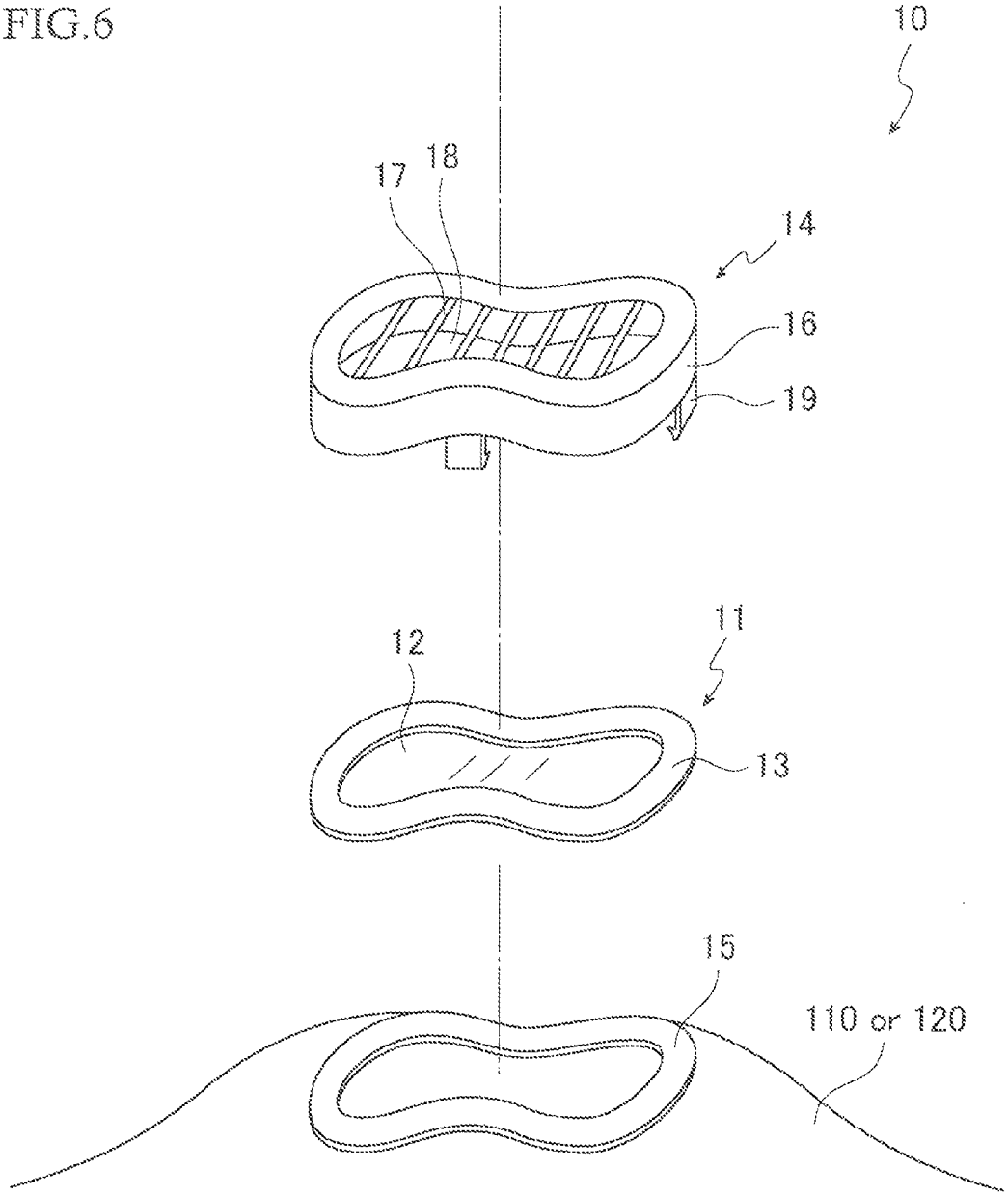
FIG. 6 is an exploded perspective view schematically showing components included in a second variation of the voice transmitter unit of Embodiment 1 of the present invention.

As shown in a second variation in FIG. 6, it may also be configured to respectively form the voice transmitter unit 10, the cover member 14, and the mounting base 15 in a shape including recessedly curved surfaces, such as a so-called gourd shape (shape defined by a pair of projectingly curved surfaces and a pair of recessedly curved surfaces) in a front view.

Although not shown in the drawings, the voice transmitter body 11, the cover member 14, and the mounting base 15 may be formed in any substantially polygonal shape other than a rectangle shape in a front view, such as a substantially pentagon and a substantially hexagon, or may be formed in a shape including an assembly of straight lines and curved surfaces which partially include substantially recessed portions. Although not shown in the drawings, in addition to the voice transmitter body 11, the cover member 14 and the mounting base 15 may be formed into any solid bodies. For example, the voice transmitter body 11 may be formed in a cone shape (recessed conical shape) or in a dome shape (swelling semi-spherical shape), and the cover member 14 and the mounting base 15 may be respectively formed in a recessed shape and a projecting shape corresponding to the shapes of the voice transmitter body 11. In this case, for example, it may be considered that the holding member 13 of the voice transmitter body 11 is formed as a frame in a cone shape or a dome shape, and the diaphragm member 12 is mounted on this frame, and is heat-shrunk, thereby forming the voice transmitter body 11 in a cone shape or a dome shape. Through this configuration, the directivity of the speech uttered by the wearer 100 is readily adjusted.

The holding member 13 may be formed in any shape other than a frame shape as far as the diaphragm member 12 can be tensed in a state of having no wrinkles and no sagging while the diaphragm member 12 is firmly fixed. For example, the holding member 13 may be formed in a substantially U shape with all corners in straight angles or a substantially U shape with round corners, or may be formed such that a pair of stick-like members are arranged in substantially parallel to each other in such a manner as to hold at least part of the diaphragm member 12 that is disposed on the inner side of the holding member 13.

Through this configuration, it is possible to flexibly form the voice transmitter unit 10 into a shape suitable to the shapes or specifications of the protective mask 110 and the protective garment 120, at the same time, in the voice transmitter body 11, it is possible to readily prevent wrinkles and sagging in the diaphragm member 12. It becomes more flexible to select respective shapes of the voice transmitter unit 10 and the voice transmitter body 11, thus facilitating designing of the protective mask 110 and the protective garment 120.

Figure 7:
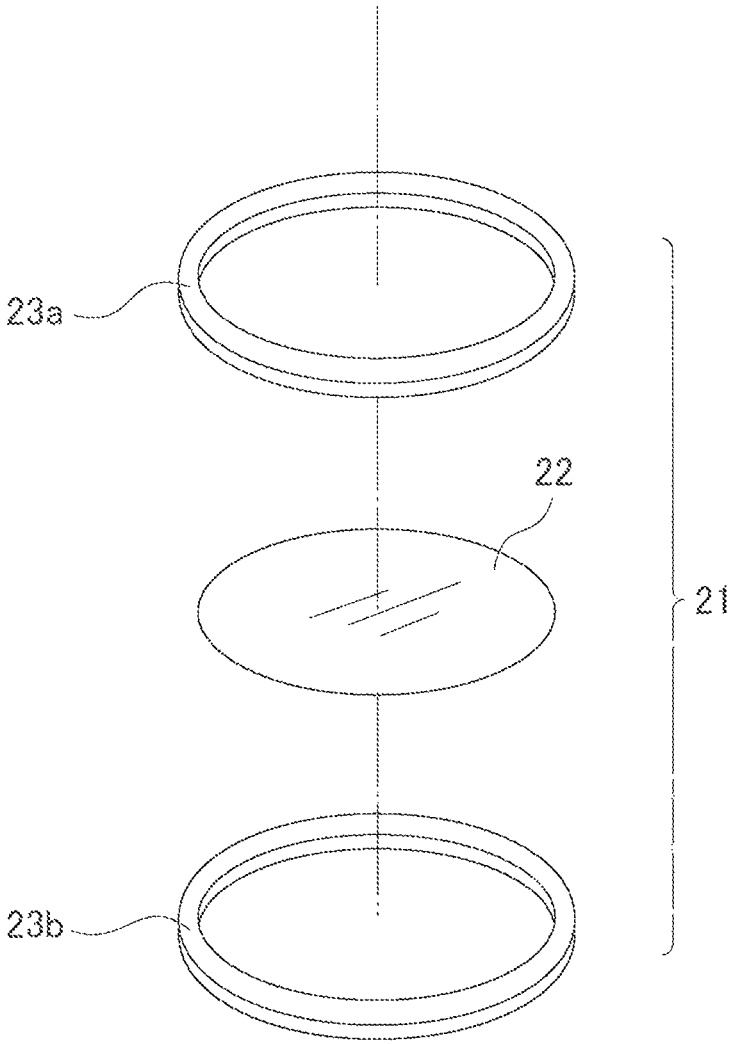
FIG. 7 is an exploded perspective view schematically showing components included in a voice transmitter body according to Embodiment 2 of the present invention.

FIG. 7 shows Embodiment 2 of the present invention.

In this Embodiment 2, there is provided a voice transmitter body 21 instead of the voice transmitter body 11 of Embodiment 1. The voice transmitter body 21 includes a diaphragm member 22 and a pair of holding members 23*a*, 23*b*.

The diaphragm member 22 of this Embodiment 2 as shown in FIG. 7 is formed in a substantially circular shape in a front view. The diameter of the diaphragm member 22 may be the same as the diameter (outer diameter) of each of the holding members 23*a*, 23*b*, or may be larger or smaller than the diameter of each of the holding members 23*a*, 23*b*. The diaphragm member 22 may be formed in any shape as far as the diaphragm member 22 is not smaller than the inner diameter of each of the holding members 23*a*, 23*b*.

Each of the holding members 23*a*, 23*b* in this Embodiment 2 is formed to be a ring-shaped frame, and holds the diaphragm member 22 therebetween. Each of the holding members 23*a*, 23*b* may have the same diameter, or one of the members, for example, the holding member 23*a* may have a larger diameter than that of the other member, for example, the holding member 23*b*.

The other components are the same as those of Embodiment 1.

In this Embodiment 2, in a fabricating process of the voice transmitter body 21 as shown in FIG. 7, the diaphragm member 22 is disposed between the pair of holding members 23*a*, 23*b*. The diaphragm member 22 is held between the pair of holding members 23*a*, 23*b*, and is firmly fixed using a desired method, and thereafter, the diaphragm member 22 is heated to be tensed so that the diaphragm member 22 is held by the holding members 23*a*, 23*b* in a state of having no wrinkles and no sagging. If the holding members 23*a*, 23*b* have different diameters from each other, a peripheral edge portion of the holding member having a greater diameter, for example, the holding member 23*a* may be wrapped around the holding member having a smaller diameter, for example, the holding member 23*b* with the diaphragm member 22 held between the holding members 23*a*, 23*b*, and in this state, the diaphragm member 22 may be held between the holding members 23*a*, 23*b* in the same manner as that of Embodiment 1.

A relation between the heating condition and the frequency characteristics of the voice transmitter unit of this Embodiment 2 was measured, and the same results as those of Embodiment 1 were obtained (see FIG. 11).

As aforementioned, in this Embodiment 2, in the voice transmitter body 21, the diaphragm member 22 can be held between the pair of holding members 23*a*, 23*b* so as to be strongly and firmly fixed, thus preventing separation of the diaphragm member 22 from the holding members 23*a*, 23*b* as well as readily producing the voice transmitter body 21 in a state in which the diaphragm member 22 has no wrinkles and no sagging.

As similar to Embodiment 1, each of the holding members 23*a*, 23*b* may have a shape other than the substantially ring shape in a front view.

FIG. 8 show Embodiment 3 of the present invention.

In this Embodiment 3, instead of the voice transmitter body 11 of Embodiment 1 and the voice transmitter body 21 of Embodiment 2, there is provided a voice transmitter body 31. The voice transmitter body 31 includes a diaphragm member 32, and a pair of holding members 33*a*, 33*b*. The diaphragm member 32 has the same configuration as that of the diaphragm member 22 of Embodiment 2.

Each of the holding members 33*a*, 33*b* is formed to be a ring-shaped frame as similar to the holding members 23*a*, 23*b* of Embodiment 2, and holds the diaphragm member 32 therebetween. However, the holding members 33*a*, 33*b* are different from the holding members 23*a*, 23*b* of Embodiment 2 in that a folding portion 34*b* is provided to a vicinity of a peripheral edge portion of the holding member 33*b*. The folding portion 34*b* is so formed as to wrappingly hold an outer edge portion of the holding member 33*a* when the holding members 33*a*, 33*b* are stacked.

The other components are the same as those of Embodiment 1.

Figure 8A:
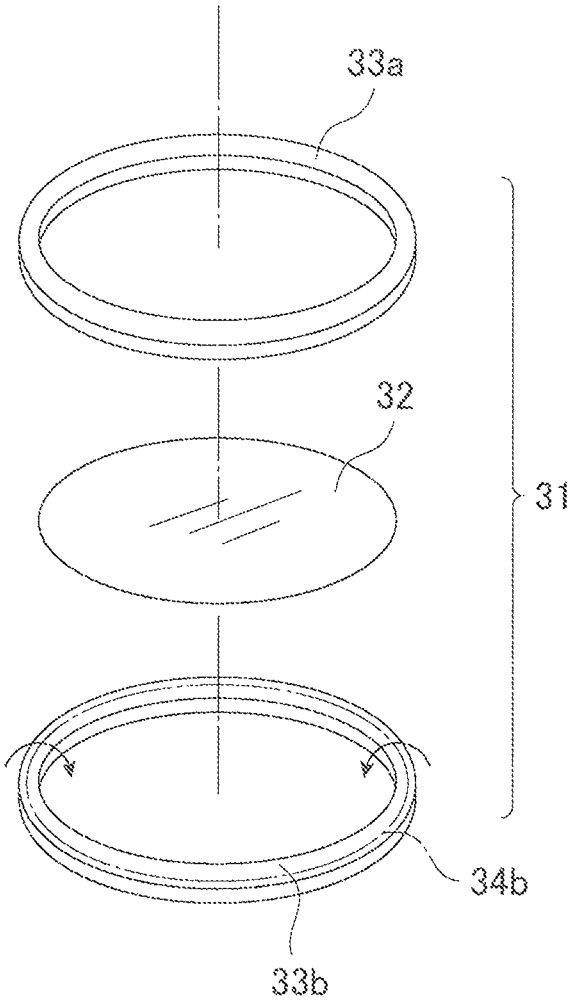
FIG. 8A is an exploded perspective view schematically showing components included in a voice transmitter body according to Embodiment 3 of the present invention.
Figure 8B:
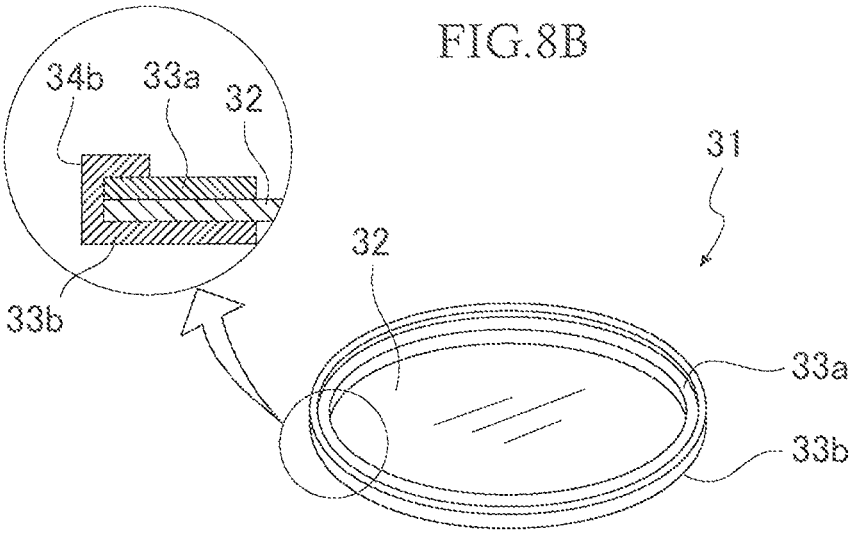
FIG. 8B is a perspective view schematically showing a state in which the voice transmitter body is assembled in the voice transmitter unit according to Embodiment 3 of the present invention.

In this Embodiment 3, in a fabricating process of the voice transmitter body 31 as shown in FIG. 8A, the diaphragm member 32 is disposed between the pair of holding members 33*a*, 33*b*. As shown in FIG. 8B, the diaphragm member 32 is held between the pair of holding members 33*a*, 33*b*, and the folding portion 34*b* is folded around to the inner side (in the upper direction of the drawing indicated by arrows in FIG. 8A) to be firmly fixed (see an enlarged view of FIG. 8B). In this state, the diaphragm member 32 is heated to be tensed so that the diaphragm member 32 is held by the holding members 33*a*, 33*b* in a state of having no wrinkles and no sagging.

A relation between the heating condition and the frequency characteristics of the voice transmitter unit of this Embodiment 3 was measured, and the same results as those of Embodiment 1 were obtained (see FIG. 11).

As aforementioned, in this Embodiment 3, in the voice transmitter body 31, the diaphragm member 32 can be held between the pair of holding members 33*a*, 33*b*, and the folding portion 34*b* can be so folded as to be strongly and firmly fixed, thus more securely preventing separation of the diaphragm member 32 from the holding members 33*a*, 33*b* as well as readily producing the voice transmitter body 31 including the diaphragm member 32 in a state of having no wrinkles and no sagging.

As similar to Embodiment 1, each of the holding members 33*a*, 33*b* may have a shape other than the substantially ring shape in a front view.

Figure 9:
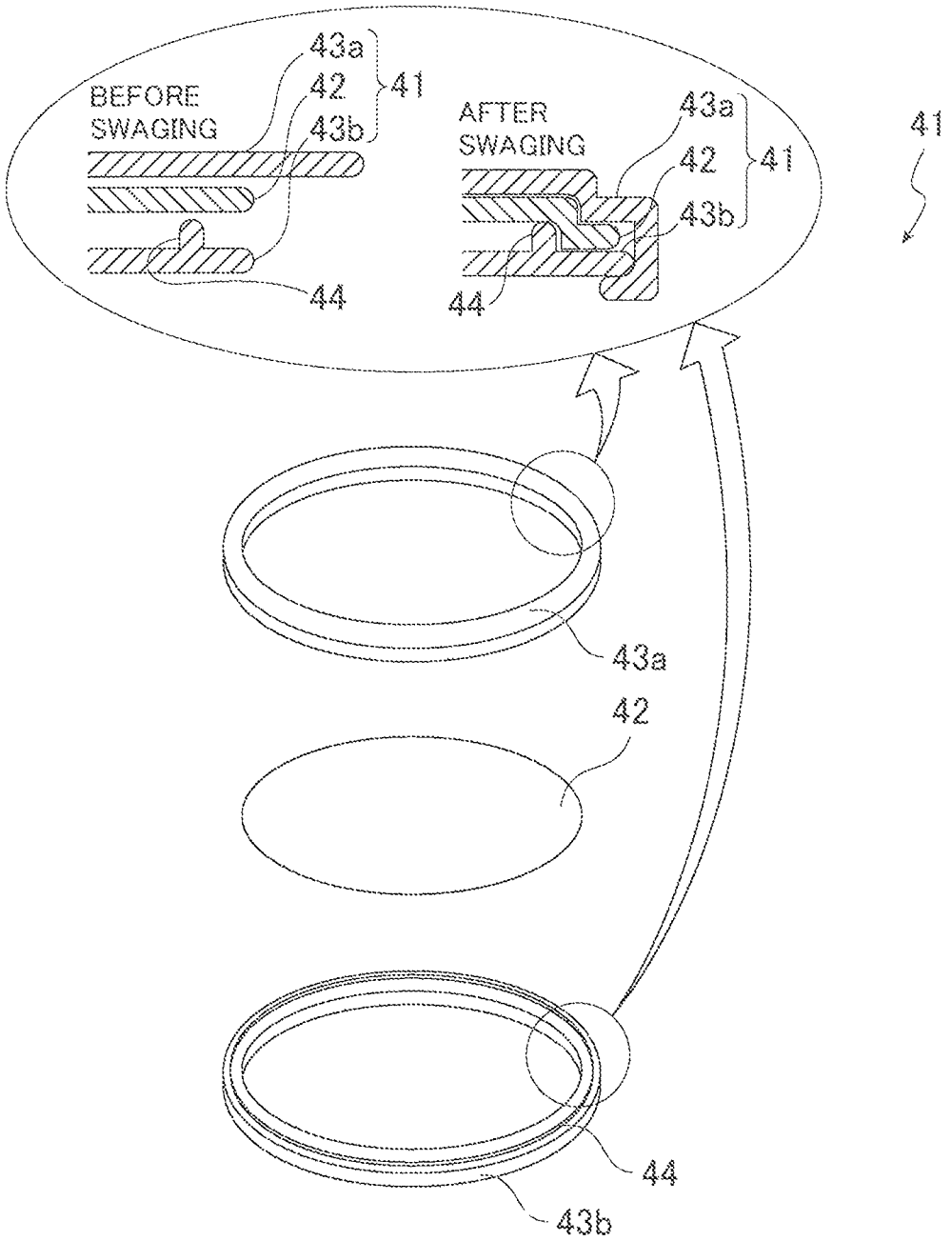
FIG. 9 is a conceptual diagram showing components included in a voice transmitter body according to Embodiment 4 of the present invention.

FIG. 9 shows Embodiment 4 of the present invention.

In this Embodiment 4, instead of the voice transmitter bodies 11, 21, 31 of Embodiments 1 to 3, there is provided a voice transmitter body 41. The voice transmitter body 41 includes a diaphragm member 42, and a pair of holding members 43*a*, 43*b*. The diaphragm member 42 has the same configuration as that of the diaphragm member 22 of Embodiment 2.

Each of the holding members 43*a*, 43*b* is formed to be a ring-shaped frame as similar to the holding members 23*a*, 23*b* of Embodiment 2, and holds the diaphragm member 42 therebetween. However, the holding member 43*b* is different from the holding member 23*b* of Embodiment 2 in that a swaging projection 44 is provided on an inner side (upper side in FIG. 9) of the holding member 43*b*.

The other components are the same as those of Embodiment 1.

In this Embodiment 4, in a fabricating process of the voice transmitter body 41 as shown in FIG. 9, the diaphragm member 42 is disposed between the pair of holding members 43*a*, 43*b*. The diaphragm member 42 is held between the pair of holding members 43*a*, 43*b* (see a state "before swaging" in an enlarged view of FIG. 9). In this state, the vicinities of peripheral edge portions of the holding members 43*a*, 43*b* are swaged with the diaphragm member 42 held therebetween, thereby enclosing a peripheral edge portion of the diaphragm member 42 and the peripheral edge portion of the holding member 43*b* by the peripheral edge portion of the holding member 43*a* so as to be firmly fixed (see a state "after swaging" in the enlarged view of FIG. 9). In this state, the diaphragm member 42 is put in a state of being tensed to some extent. In this state, the diaphragm member 42 is heated to be tensed so that the diaphragm member 42 is held in a state of having no wrinkles and no sagging by the holding members 43*a*, 43*b*.

A relation between the heating condition and the frequency characteristics of the voice transmitter unit of this Embodiment 4 was measured, and the same results as those of Embodiment 1 were obtained (see FIG. 11).

As aforementioned, in this Embodiment 4, in the voice transmitter body 41, tension is applied to the diaphragm member 42 at the swaging projection 44 to some extent by swaging the pair of holding members 43*a*, 43*b* with the diaphragm member 42, and in this state, the diaphragm member 42 is heated to be shrunk, thereby more securely preventing generation of wrinkles and sagging in the diaphragm member 42. Because the diaphragm member 42 can be so held by the holding members 43*a*, 43*b* as to be strongly and firmly fixed, it is possible to more securely prevent separation of the diaphragm member 42 from the holding members 43*a*, 43*b*, and readily produce the voice transmitter body 41 including the diaphragm member 42 in a state of having no wrinkles and no sagging.

As similar to Embodiment 1, each of the holding members 43*a*, 43*b* may have a shape other than the substantially ring shape in a front view.

Figure 10:
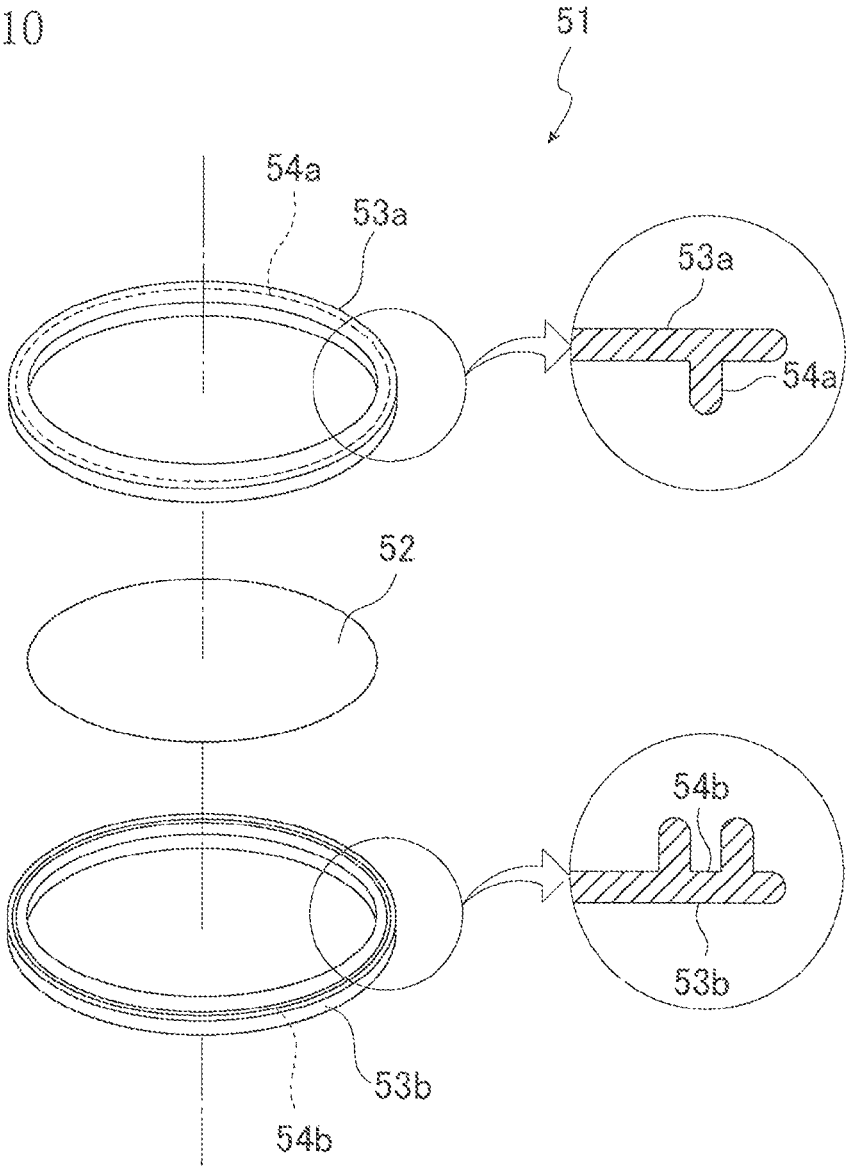
FIG. 10 is a conceptual diagram showing components included in a voice transmitter body according to Embodiment 5 of the present invention.

FIG. 10 shows Embodiment 5 of the present invention.

In this Embodiment 5, instead of the voice transmitter bodies 11, 21, 31, 41 of Embodiments 1 to 4, there is provided a voice transmitter body 51. The voice transmitter body 51 includes a diaphragm member 52, and a pair of holding members 53*a*, 53*b*. The diaphragm member 52 has the same configuration as that of the diaphragm member 22 of Embodiment 2.

Each of the holding members 53*a*, 53*b* is formed to be a ring-shaped frame as similar to the holding members 23*a*, 23*b* of Embodiment 2, and holds the diaphragm member 52 therebetween. However, the holding members 53*a*, 53*b* are different from the holding members 23*a*, 23*b* of Embodiment 2 in that a fitting projection 54*a* is disposed on an inner side (lower side in FIG. 10) of the holding member 53*a*, and a fitted recess 54*b* is disposed on an inner side (upper side in FIG. 10) of the holding member 53*b*, respectively. The fitting projection 54*a* and the fitted recess 54*b* are so provided at respective positions as to overlap each other when the holding members 53*a*, 53*b* are stacked.

The other components are the same as those of Embodiment 1.

In this Embodiment 5, in a fabricating process of the voice transmitter body 51 as shown in FIG. 10, the diaphragm member 52 is disposed between the pair of holding members 53*a*, 53*b*. The diaphragm member 52 is held between the pair of holding members 53*a*, 53*b*. At this time, the fitting projection 54*a* of the holding member 53*a* is fitted to the fitted recess 54*b* in such a manner as to be firmly fixed to each other with the diaphragm member 52 held therebetween. In this state, the diaphragm member 52 is heated to be tensed so that the diaphragm member 52 is held in a state of having no wrinkles and no sagging by the holding members 53*a*, 53*b*.

A relation between the heating condition and the frequency characteristics of the voice transmitter unit of this Embodiment 5 was measured, and the same results as those of Embodiment 1 were obtained (see FIG. 11).

As aforementioned, in this Embodiment 5, in the voice transmitter body 51, because the fitting projection 54*a* and the fitted recess 54*b* of the pair of holding members 53*a*, 53*b* are so fitted to each other as to hold the diaphragm member 52 therebetween, thereby strongly and firmly fixing the diaphragm member 52, it is possible to more securely prevent separation of the diaphragm member 52 from the holding members 53*a*, 53*b* as well as readily produce the voice transmitter body 51 including the diaphragm member 52 in a state of having no wrinkles and no sagging.

As similar to Embodiment 1, each of the holding members 53*a*, 53*b* may have a shape other than the substantially ring shape in a front view.

In the aforementioned embodiments, it is configured that the diaphragm member 12 is mounted on the holding member 13, the diaphragm members 22, 32, 42, 52 are respectively held by the holding members 23*a* and 23*b*, 33*a* and 33*b*, 43*a* and 43*b*, and 53*a* and 53*b*, and thereafter, the diaphragm members 12, 22, 32, 42, 52 are respectively heated to be shrunk. Instead of this, it may be configured that each of the diaphragm member 12 and the holding member 13, the diaphragm member 22 and the holding members 23*a*, 23*b*, the diaphragm member 32 and the holding members 33*a*, 33*b*, the diaphragm member 42 and the holding members 43*a*, 43*b*, and the diaphragm member 52 and the holding members 53*a*, 53*b* is formed of a thermoplastic material such as polypropylene, the diaphragm member 12 and the holding member 13, the diaphragm member 22 and the holding members 23*a*, 23*b*, the diaphragm member 32 and the holding members 33*a*, 33*b*, the diaphragm member 42 and the holding members 43*a*, 43*b*, and the diaphragm member 52 and the holding members 53*a*, 53*b* are firmly joined by welder processing or the like, respectively, and thereafter, each of the diaphragm members 12, 22, 32, 42, 52 is heated to be shrunk. Through this configuration, it is possible to firmly connect the diaphragm member 12 and the holding member 13, the diaphragm member 22 and the holding members 23*a*, 23*b*, the diaphragm member 32 and the holding members 33*a*, 33*b*, the diaphragm member 42 and the holding members 43*a*, 43*b*, and the diaphragm member 52 and the holding members 53*a*, 53*b*, respectively, and it is also possible to more securely remove wrinkles and sagging of each of the diaphragm members 12, 22, 32, 42, 52.

It is needless to mention that each of the aforementioned Embodiments is an exemplification of the present invention, and it is not meant that the present invention is not limited only to the aforementioned Embodiments.

The invention claimed is:

1. A voice transmitter used in a voice transmitter unit of a protective member that protects respiration of a wearer from polluted air, the protective member including: a main body to cover at least a front of a mouth of the wearer; an air intake mechanism to supply clean air into the main body; and the voice transmitter unit so disposed inside the main body as to transmit speech uttered by a wearer to an outside, the voice transmitter comprising:

a holding member formed to be a frame having a predetermined shape; and a diaphragm member to cover an entire aperture formed on an inner side of the holding member, the diaphragm member being made of a heat-shrinkable material through which the speech is transmittable, wherein the diaphragm member heat-shrunk while the holding member is covered with the diaphragm member, and a tension state is applied to substantially an entire surface of the diaphragm member so as to remove wrinkles and sagging therefrom, and the diaphragm member is held by the frame member in such a manner as to maintain the tension state.

2. The voice transmitter according to claim 1, wherein an entire area of one surface of the holding member is covered with the diaphragm member, a peripheral edge portion of the diaphragm member is wrapped around under the other surface of the holding member, and subsequently, the diaphragm member is heated to be heat-shrunk in a state in which no tension is applied thereto, thereby holding the diaphragm member by the holding member while the tension is maintained.

3. The voice transmitter according to claim 1, wherein a peripheral edge portion of the diaphragm member is firmly fixed to the holding member while no tension is applied to the diaphragm member, and thereafter, the diaphragm member is heated to be heat-shrunk so as to hold the diaphragm member by the holding member while the tension is maintained.

4. The voice transmitter according to claim 1, wherein at least one of a heating temperature and a heating time of the diaphragm member is so controlled as to adjust the tension applied to the diaphragm member to be a predetermined value.

5. The voice transmitter according to claim 1, wherein the aperture of the holding member has a shape defined by a pair of projecting curved surfaces and a pair of recessed curved surfaces in plain view.

6. The voice transmitter according to claim 1, wherein the aperture of the holding member has a polygonal shape other than a rectangular shape in plain view.

* * * * *